United States Patent [19]

Horn

[11] Patent Number: 4,506,866

[45] Date of Patent: Mar. 26, 1985

[54] VEHICLE HOIST

[76] Inventor: Don M. Horn, P.O. Box 4050, Regina, Saskatchewan, Canada, S4P 3R9

[21] Appl. No.: 446,077

[22] Filed: Dec. 1, 1982

[30] Foreign Application Priority Data

Jan. 5, 1982 [CA] Canada ..... 393581

[51] Int. Cl.[3] ..... B66F 5/04

[52] U.S. Cl. ..... 254/2 B; 254/3 B; 254/84; 254/93 L; 187/8.5

[58] Field of Search ..... 254/2 R, 2 B, 2 C, 3 R, 254/3 B, 3 C, 45, 84, 93 R, 93 L; 414/678; 187/8.41, 8.5, 8.49

[56] References Cited

U.S. PATENT DOCUMENTS

| | | | |
|---|---|---|---|
| 1,697,364 | 1/1929 | McCollum et al. . | |
| 2,805,839 | 9/1957 | Branick . | |
| 3,150,784 | 9/1964 | Rothe . | |
| 3,223,251 | 12/1965 | Rothe et al. . | |
| 3,361,408 | 1/1968 | Strang et al. | 254/2 R |
| 3,363,778 | 1/1968 | Larsson . | |
| 3,402,828 | 9/1968 | Vilter . | |
| 3,582,043 | 6/1971 | Tranchero . | |
| 3,647,183 | 3/1972 | Rishovd . | |
| 3,836,014 | 9/1974 | Johansson . | |
| 3,844,421 | 10/1974 | Nielsen | 414/678 |
| 4,158,524 | 6/1979 | Serafin . | |
| 4,203,505 | 5/1980 | Johansson | 254/2 C X |

FOREIGN PATENT DOCUMENTS

| | | |
|---|---|---|
| 215101 | 1/1922 | Canada . |
| 222663 | 8/1922 | Canada . |
| 227618 | 1/1923 | Canada . |
| 235380 | 11/1923 | Canada . |
| 237130 | 1/1924 | Canada . |
| 946371 | 4/1974 | Canada . |
| 1029714 | 4/1978 | Canada . |
| 1556383 | 1/1970 | Fed. Rep. of Germany . |
| 2117451 | 10/1971 | Fed. Rep. of Germany . |
| 2941875 | 4/1980 | Fed. Rep. of Germany . |
| 1566040 | 5/1969 | France . |
| 741783 | 12/1955 | United Kingdom . |

*Primary Examiner*—Frederick R. Schmidt
*Assistant Examiner*—Steven P. Schad
*Attorney, Agent, or Firm*—Pollock, Vande Sande and Priddy

[57] ABSTRACT

A vehicle hoist has an inclined column along which a carriage having normally horizontal support members is moved. The carriage is moved by a hydraulic cylinder and engages the column in a ratchet-like fashion allowing upwards movement but preventing the lowering of the carriage unless a release mechanism is actuated simultaneously with the hydraulic valve governing the cylinder. The invention improves safety and provides smooth surfaces about the column.

3 Claims, 10 Drawing Figures

VEHICLE HOIST

BACKGROUND OF THE INVENTION

The present invention relates to a vehicle hoist of the type including a base, an inclined column fixedly secured to the base and vehicle support means secured to a carriage which is displaceable along the column.

Vehicle hoists of the above type have long been known in the art and have found a broad acceptance in car repair workshops due to their relatively low price and also due to their relative rigidity and manoeuverability.

Prior art typical of the field to which the present invention pertains is represented by Canadian Pat. No. 946,371, (Johansson); U.S. Pat. No. 3,363,778 (Larsson); U.S. Pat. No. 3,402,828 (Vilter); and U.S. Pat. No. 3,647,183 (Rishovd).

Generally speaking, the drawback of known lift devices of this type is seen particularly in relatively complex configuration of the different elements of the hoist which make the work with them relatively hazardous. Some of the known devices have hydraulic lifting means which are deemed to be preferred for this type of equipment, combined with mechanical device designed to prevent the carriage from inadvertently dropping down on defect of the hydraulic device. The above Vilter patent is one example of such prior art. The device is relatively cumbersome to operate and may result in the operator eventually abandoning the use of the mechanical safety device (a chain in the case of the Vilter patent) thus increasing the danger of accidental sudden drop of the carriage of the lift.

It is a primary object of the present invention to provide a vehicle lift of the above type in which the safety of operation would be improved and which would produce as smooth surfaces of the individual components of the lift as possible, particularly as regards the column housing the lifting carriage.

In accordance with one aspect of the present invention, a vehicle hoist is provided of the type including a base disposed normally horizontally on the ground and having a first end portion and a second end portion; a column fixedly secured to the base and extending upwards therefrom at an inclination such that a bottom end of the column is secured to said base at a point relatively close to but spaced from said first end portion and a top end of said column is generally vertically above said first end portion; carriage means disposed in said column for movement therein in the direction from one of said ends of the column to the other; first hydraulic power means operatively associated with said carriage means for selectively moving same along the column on actuation of manual control means; vehicle support means secured to said carriage and protruding from same in a direction away from that face of said column which is turned away from said first end portion; mechanical lock means normally biased such as to prevent the movement of said carriage means in the direction from the top end to the bottom end of the column; manual lock release means independent of and distinct from said manual control means for actuating said lock means against its bias, the manual lock release means being of the type requiring a continuous manual force to maintain the lock means in released state; whereby an operator must use his both hands to initiate the descent of said carriage means and must maintain manual force on said lock release means throughout the descending of the carriage means.

Preferably, the lock release means is disposed at that face of said column which is turned away from the vehicle support means, thus making it necessary for an operator to stand out of reach of the supported vehicle if the hoist is to be lowered.

According to a further feature of the present invention, the column is a structure of channel shaped cross-sectional configuration comprising a generally solid bottom wall provided with a plurality of transverse locking protrusions; a pair of side walls extending along each side of the bottom wall, each side wall having a longitudinally inwardly turned flange forming guide means for guiding said carriage along the bottom wall, said carriage being provided with transverse locking bar means complementary with said locking protrusions, and spring means resiliently urging said locking bar means into engagement with said locking protrusions; said locking protrusions being each a generally triangular cross-sectional shape defined by a locking surface generally perpendicular to the bottom wall, and by a wedging surface extending from the free end portion of the locking surface downwards and merging with the bottom wall, whereby the movement of the carriage upwards results in automatic release of the locking bar means in a ratchet-like fashion. The column thus provides smooth surface which is less susceptible to becoming inadvertently obstructed by a tool or the like, thus increasing the safety of operation. Also, the column has a smooth exterior surface.

In accordance with a further feature of the present invention, the hoist comprises a lock release bar extending along said bottom wall and generally centrally thereof and arranged for pivotal movement about an axis perpendicular with the elongation of the bar; said lock release bar being disposed between the bottom wall and the locking bar means, whereby a displacement of a portion of the lock release bar away from the bottom wall displaces the locking bar means from engagement with the respective locking protrusion. This arrangement provides an extremely simple, yet effective lock release, resulting in relatively low production costs of the particular elements.

The smooth exterior surfaces of the column are further enhanced by a further feature of the present invention in accordance with which the bottom wall, the side walls and the flanges are solid walls integral with each other and completely enclosing.the carriage at its sides and at its face turned toward said first end portion of the base, leaving only a part of one face of the carriage exposed between said flanges.

In order to enhance manoeuverability of the supported vehicle, the hoist of the present invention may be arranged such that said vehicle support means is pivotally secured to said carriage means for pivotal movement about a transverse axis closely spaced from said carriage, said hoist further comprising second hydraulic power means operatively associated with said vehicle support means and with said carriage means for selectively adjusting said vehicle support means from a normally generally horizontal position to a tilted position whereby the vehicle supporting means slopes downwardly and towards the column at an angle of inclination of about 20°.

In order to increase the manoeuverability of the hoist, particularly when the hoist is to be displaced while not supporting a vehicle, the hoist further comprises ground engaging wheels secured to said base and operatively associated with wheel mounting means adapted to allow displacement of said wheels from an extended position at which the wheels support the base at a spacing above the ground, to a retracted position wherein the base rests on the ground; and wheel extending spring means urging the wheels into said extended position, by a spring force only slightly greater than the weight of said hoist, whereby the wheels are forced into the retracted position when a vehicle is supported by same.

Thus, on engagement with a vehicle to be supported, the base of the hoist rests safely on the ground of a workshop, while, with the vehicle not supported by the hoist, the ground wheels extend automatically to enable withdrawal of the lift or the like manoeuvering, without any additional operation being required.

Thus, on engagement with a vehicle to be supported, the base of the hoist rests safely on the ground of a workshop, while with the vehicle not supported by the hoist, the ground wheels extend automatically to enable withdrawal of the lift or the like manoeuvering, without any additional operation being required.

The invention will now be described by way of a preferred embodiment with reference to the accompanying drawings, in which.

Figure 1:
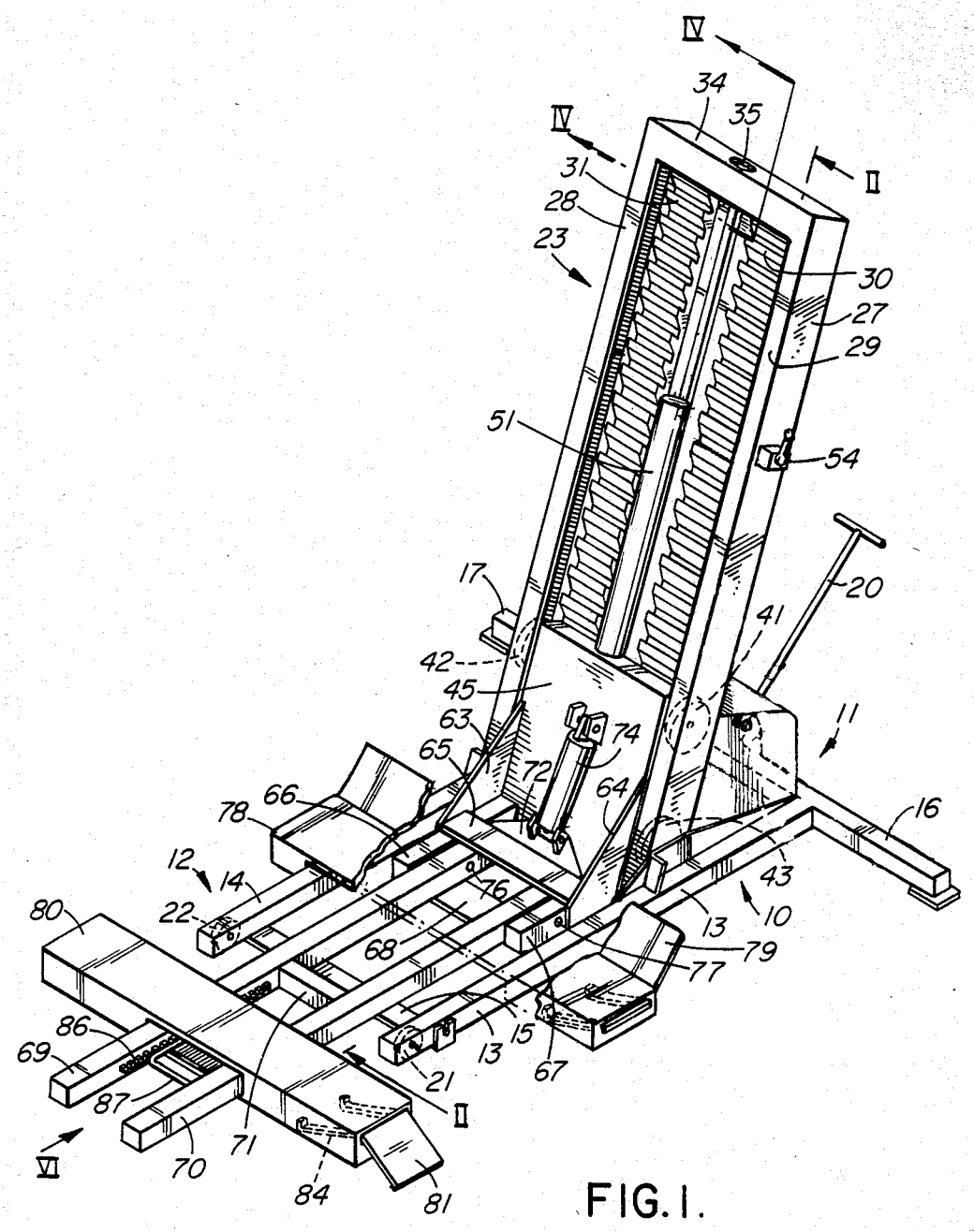
FIG. 1 is a simplified perspective view of the hoist of the present invention, partly broken away.
Figure 3A:
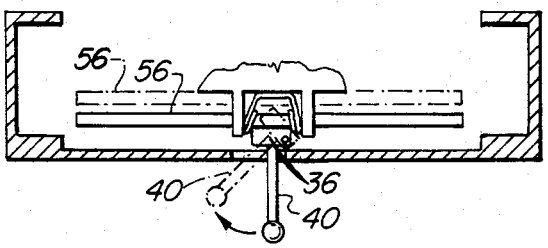
Figure 2:
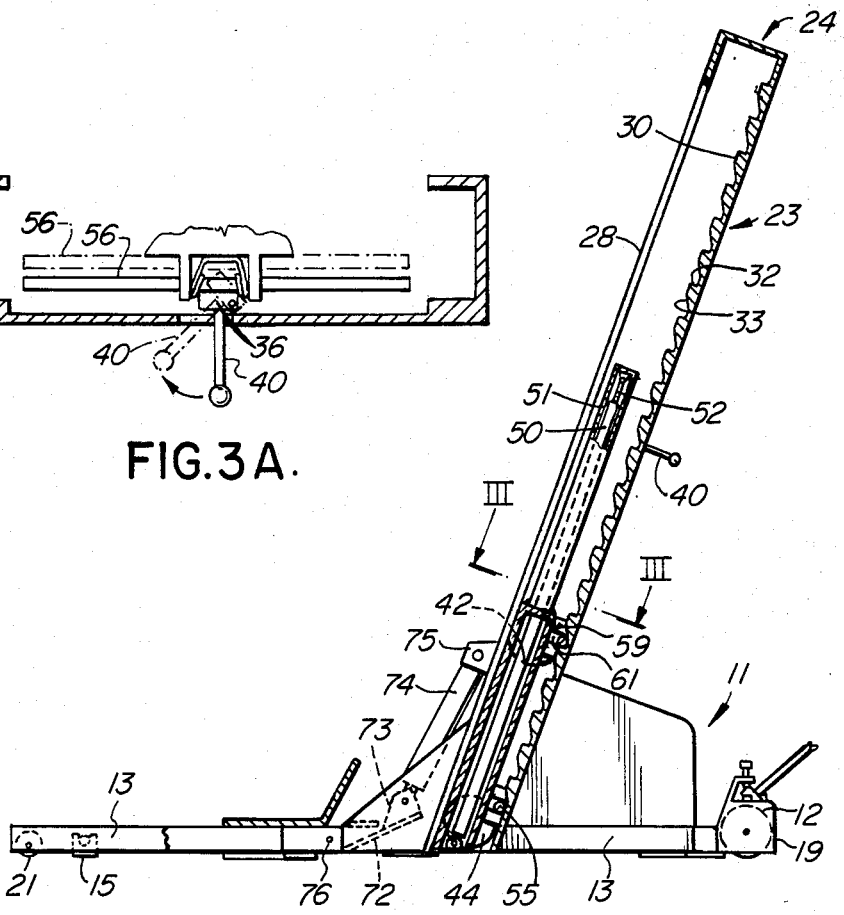
FIG. 2 is section II—II of FIG. 1 with certain parts omitted for the sake of clarity.
Figure 3:
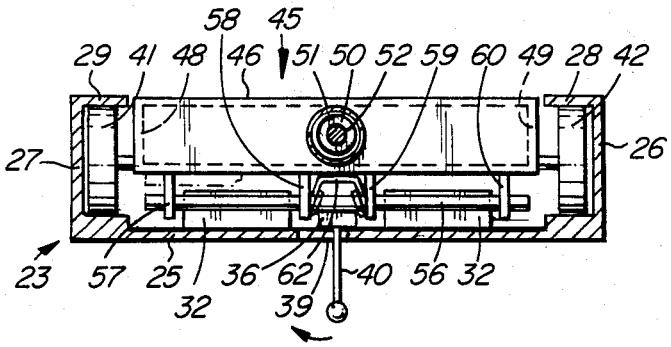
Figure 5:
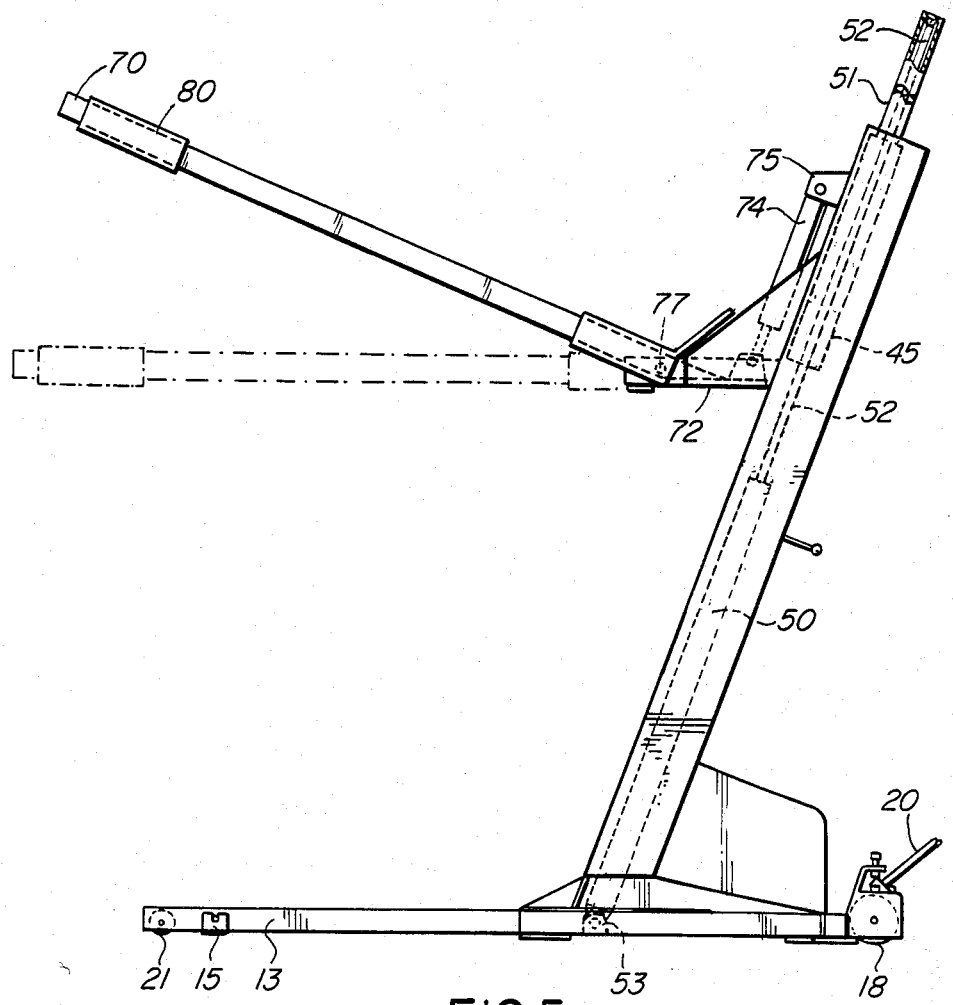
Figure 4:
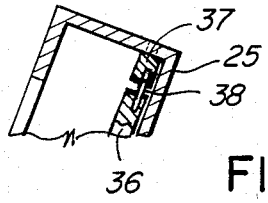
Figure 7:
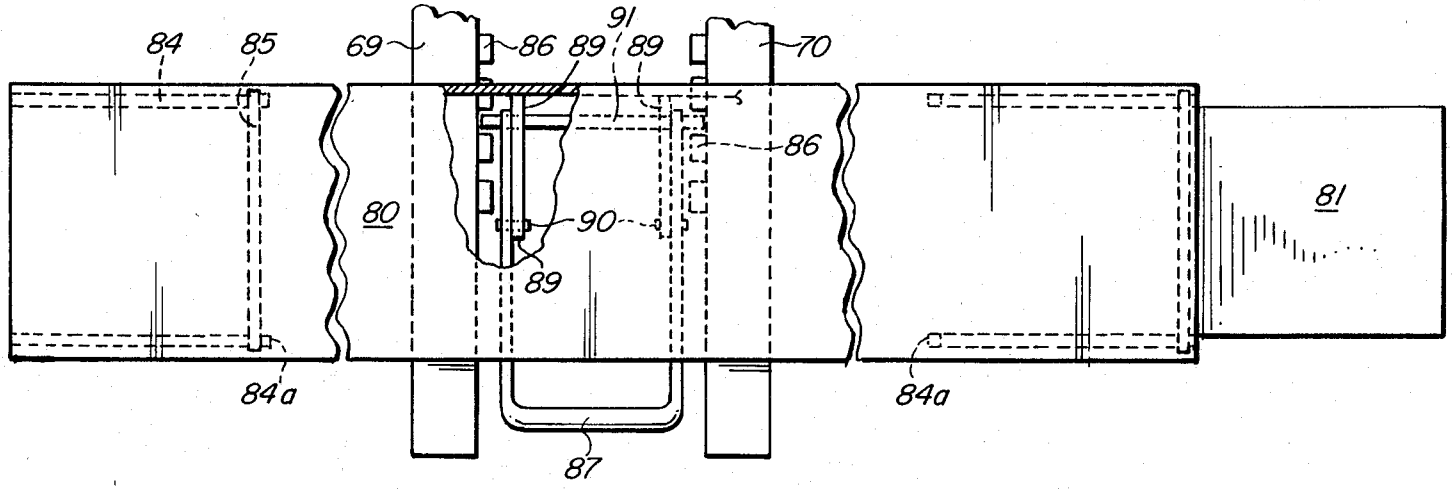
Figure 6:
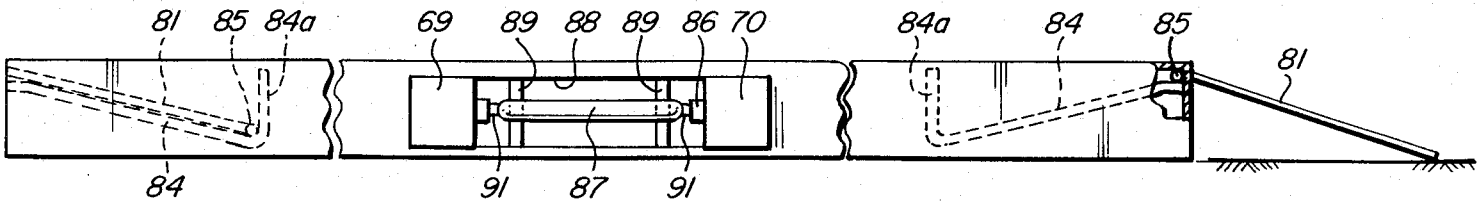
Figure 8:
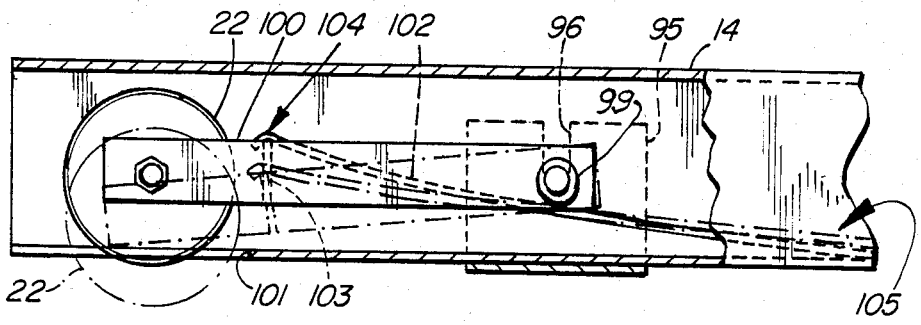
Figure 9:
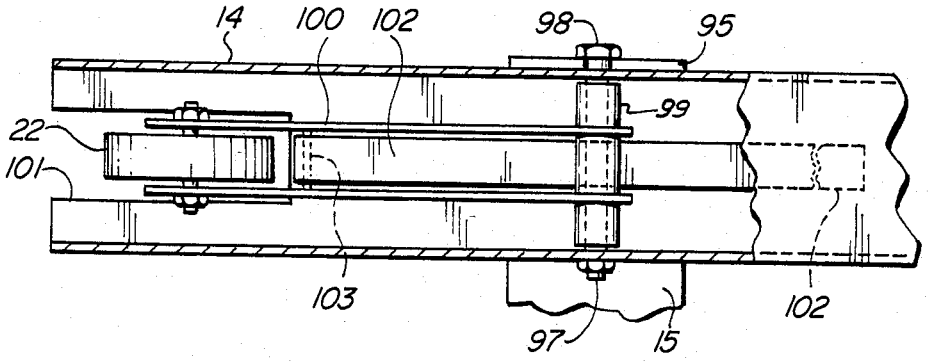

FIG . 3 is section III—III of FIG. 2 with certain parts omitted for the sake of clarity;

FIG. 3*a* is a view (on enlarged scale) similar to that of FIG. 3 with certain parts of FIG. 3 omitted for the sake of clarity;

FIG. 4 is partial section IV—IV of FIG. 1;

FIG. 5 is a side view showing the carriage in top position and the supporting arms in an inclined position;

FIG. 6 is an end view in direction VI of FIG. 1 of the outer pad of the hoist;

FIG. 7 is a plan view of FIG. 6;

FIG. 8 is detail VIII—VIII of FIG. 5, partly broken away showing an exemplary embodiment of the ground wheel mounting; and FIG. 9 is a plan view of FIG. 8, partly broken away.

Reference numeral 10 in FIG. 1 generally designates a base of the hoist whose ends will be referred to, for convenience, as a first end portion 11 and a second end portion 12. As is known, the base is formed by two box-shaped, generally straight side members, 13, 14. Near the second end portion 12, a spacer 15 is fixedly secured to the side members 13, 14, to maintain same at a uniform spacing from each other. At the first end portion 11, the respective ends of the side members 13, 14 are secured to transversely extending stabilizing legs 16, 17, it being understood that the legs 16, 17, even though shown as fixedly secured to the side members 13, 14, can fold or slide into the adjacent parts of base 10, as is well known from prior art. The base 10 is provided, at its first end portion 11, with a steering wheel 18. The steering wheel mechanism is of the type well known in the art of hand trucks used in workshop material handling and therefore not described in greater detail. Briefly, the wheel is mounted in a housing 19 and is steered by a pull rod 20, pivoting the bracket or the like mount of the wheel 18 about a horizontal axis. By the same token, the mounting of the wheel 18 in the housing 19 is such that the lowering of the pull rod 20 to a horizontal position results in the wheel 18 becoming retracted into the housing 19 whereby the first end portion 11 rests on the ground. The pull rod 20 is preferably detachable to avoid unnecessary obstruction when the hoist is in place.

At the opposite, second end portion 12, ground wheels, 21, 22 are provided whose spring-loaded suspension will be described in greater detail as the specification proceeds. It can be appreciated from the above, that the base 10 is disposed normally horizontally on the ground.

A column 23 is fixedly secured to the base 10. As best seen from FIG. 2 but also from FIG. 1, the column extends upwards and at an inclination such that the lowermost end of the column is welded to the base at a point relatively close to but spaced from the first end portion 11. The top end 24 of the column is disposed generally vertically above the first end portion 11, as best seen from FIG. 2. As can be best appreciated from FIG. 3, the column 23 is of a generally channel-shaped structural configuration including a solid bottom wall 25, mutually opposite, solid side walls 26, 27, having each an inwardly turned flange 28, 29, respectively. The bottom wall 25 is provided with a pair of longitudinal racks 30, 31, each integral with the bottom wall 25 and disposed along the respective side walls 26, 27. The racks 30, 31 define a plurality of locking pads, each locking pad having a top surface 32 and a wedging lower surface 33 which merges, at its lowermost end, with the top surface 32 of a subsequent locking pad.

At the top end 24 of the column 23, the channel-shaped configuration is enclosed by a top flange 34 (FIG. 1) in which is provided a central passage 35 the purpose of which will be referred to hereinafter.

It will be appreciated from the above description, that the column 23 of the above configuration presents a structure having smooth outer surfaces along the bottom wall and on the sides, the structure being open solely in its portion turned towards the second end portion 12 of the base.

Disposed centrally of the column and along the bottom wall 25 (FIG. 3) is a lock release rod 36. The rod is secured to the column near the top flange 34 by way of a block 37 forming a pivot bearing with a pivot pin 38 whose axis is parallel with elongation of the rod 36 and with the bottom wall 25. The pivot pin 38 is fixedly secured to the adjacent end of the rod 36 and is offset relative to the rectangular cross-section of the rod 36 such that the pin 38 generally coincides with the lower right corner of the shape of the rod 36 as seen in broken lines (FIG. 3*a*). A similar mounting arrangement (not shown in the drawings) is provided at the lower end of column 23. At approximately mid-height of the lock release rod, a handle 40 is fixedly secured to the rod 36. The handle 40 protrudes through a suitably located slot 39 in the bottom wall 25 as best seen in FIG. 3. It will thus be appreciated that on moving the handle 40 to the left of FIG. 3, the rod 36 is brought from a generally flush relationship with the bottom wall 25 to a clockwise displacement as shown in FIG. 3*a*.

The flanges 28 and 29 of the column 23 cooperate with the opposite sections of the bottom wall 25 to provide a guide for four carriage wheels 41, 42, 43 and 44. As best seen from FIG. 1, the carriage wheels 41, 42 form an upper pair of wheels and the other two wheels 43, 44 (44 shown in FIG. 2 only) form a lower pair of carriage wheels. The wheels are pivotally secured to a flat box-shaped carriage 45. The carriage has a flat, smooth front wall 46, a rear wall 47 normally facing the bottom wall 25 of the column 23, and two side walls 48, 49. It is shown by FIG. 3 that the side walls 48, 49 define the width of the rectangular box-shaped carriage which is slightly less than the spacing of free ends of the flanges 28, 29 of the column 23. Thus, the carriage 45 can travel up and down along the column 23.

The travel of the carriage 45 along the column is controlled by a hydraulic cylinder 50 which, in a fully retracted state, is disposed within a cylindric casing 51, to whose upper end is secured the piston rod 52 of the cylinder 50. The lower end of the cylinder 50 is pivotally secured to the base 10 at a pivot joint 53. The actuation and control of the hydraulic cylinder is well known in the art and can be effected in many different ways. A switch 54 (FIG. 1) is operatively connected by means not shown in detail with an electric device associated with a hydraulic pump and with a valve for selectively extending or retracting the piston rod 52 from the hydraulic cylinder 50. The electric circuitry and the hydraulic arrangement of cylinder 50 need not be shown in detail; a great number of different embodiments of such control circuitry exists, and it is visualized that the whole arrangement of the hydraulics would be comprised of an assembly purchased by the manufacturer of the present hoist from the manufacturers of hydraulic devices. It will suffice, to state at this point that the switch 54 has two operative positions, one causing the hydraulic cylinder 50 to displace the carriage 45 upwards, the other controlling a release valve, allowing the downwards movement of the carriage 45 due to the release of hydraulic fluid from the cylinder 50 as is well known in the art. The casing 51, of course, is fixedly secured to the carriage 45 such that it moves simultaneously with same along the column 23 and through the passage 35 at the top thereof.

Turning now to FIG. 2, reference may be had to a pair of transverse locking rods 55, 56 of which rod 56 is near the upper end of the carriage 45 and rod 55 near the bottom end thereof. The securement of the rods 55, 56 to the structure of carriage 45 can be appeciated on review of FIG. 3 only the rod 56 is visible in this Figure, it being understood that the arrangement of the lower rod 55 is identical with that of rod 56. The rod is mounted in four brackets 57, 58, 59 and 60 welded to the rear wall 47 of the carriage 45. Of these brackets, bracket 59 can be recognized in FIG. 2 as having a longitudinal slot 61. Each of the brackets 57–60 has a similar slot. A spring 62 is secured to the rod 56 and engages the rear wall 47 of the carriage to urge the rod 56 away from the carriage in a direction towards the bottom wall 25 of column 23. In so doing, the spring causes the aforesaid lock release rod 36 to stay generally in a position generally as shown in FIG. 3 or in full lines of FIG. 3*a*. The purpose of the spring is to resiliently maintain the rod 56 in a position as shown in FIG. 3. The spring tension of spring 62 can be overcome on manual tilting of the handle 40 clockwise, whereby the rod 36 becomes displaced with its upper left edge (FIG. 3 or 3*a*) pushing the rods 55, 56 to the left of FIG. 2. The extreme position of the release rod 36 is shown in FIG. 3*a* by broken lines. As mentioned before, the structural configuration of the mounting of the transverse locking rod 55 at the lower end of the carriage 45 is identical. It is shown in FIGS. 2 and 3 that the cross-secitonal shape of the locking rod 56 is compatible with top surfaces 32 of racks 30, 31.

It will be readily appreciated by those skilled in the art that as the carriage travels upwards, the wedging surfaces 33 cause the locking bars 55, 56 in and out of engagement with the respective top surfaces. On the other hand, when the hydraulic cylinder 50 is actuated to allow downward movement of the carriage 45, the locking bars 55, 56 prevent a downward movement of the carriage 45 unless the bars 55, 56 are released by the lock release rod 36 as described. Accordingly, when the carriage 45 is to be lowered, the operator must use his or her both hands to achieve the downward movement of the carriage 45. By merely operating the switch 54, the carriage will only travel to the nearest top surfaces 32 whereupon the engagement of rods 55, 56 with such surface results in locking the carriage and preventing it from further movement downwards. By the same token, if a defect should occur in the hydraulic system which might cause sudden drop of the carriage 45, the lock release rods 56, 55 will prevent accidental drop of the carriage in the same way. Similarly, under normal operating conditions, merely releasing the engagement between the bars 55, 56 and the surfaces 32 will not result in the lowering of the carraige unless the switch 54 is actuated to let the hydraulic cylinder 50 drop the carriage.

The hydraulic cylinder 50 and its associated elements can also be referred to as "first hydraulic power means" operatively associated with said carriage means for selectively moving same along the column on actuation of manual control means, the manual control means being the switch 54.

The system of locking bars 55, 56 can be referred to as mechanical lock means normally biased such as to prevent the movement of the carriage means 45 in the direction from the top end to the bottom end of the column 23. By the same token, the handle 40 and the lock release bar 36, can be referred to, in general terms, as manual lock release means independent of and distinct from said manual control means. The manual lock release means is of the type requiring a continuous manual force to maintain the lock means in released state, as described above.

From the front wall 46 of the carriage 45 and near the lower end thereof protrude two parallel, triangular strut plates 63, 64 (FIG. 1). The strut plates are integral, for instance by welding, with a flat transverse plate 65. Two side elements 66 and 67 are fixedly secured to the strut plates 63 and 64 and to a top or first transverse plate 65 and are thus also integral with the carriage 45. The side elements 66 and 67 are generally parallel with each other and with the aforesaid side members 13 and 14 of the base of the hoist. Their free ends are interconnected with a second transverse plate 68 which, contrary to the transverse plate 65, is fixedly secured to the underneath surface of the side elements 66, 67. Thus, the side elements 66, 67 and the transverse plates 65, 68 combine to form a passage which, when viewed from the left of FIG. 1, is of horizontally elongate rectangular contour. Within that contour is received a pair of support beams 69, 70 generally parallel with the side members 13 and 14, and of course, with the side elements 66 and 67 and maintained at a uniform, parallel spacing from each other by a transverse member 71. The support beams 69, 70 are provided, near the end thereof adjacent to the carriage 45, with an upwardly sloping mounting plate 72 carrying brackets 73 (FIG. 2) for pivotal securement to the plate 72 of a lower end of a second hydraulic cylinder 74. The piston rod of the second hydraulic cylinder near the top thereof (FIG. 1) is pivotally secured to the brackets 75 welded to the front wall 46 of the carriage 45. The support beams 69, 70 are pivotal about the side elements 66, 67 at coaxial pivot joints 76, 77. Accordingly, the actuation of the second hydraulic cylinder 74 in a desired manner results in two positions of which the generally horizontal position is shown in FIG. 2 and an inclined position is shown in FIG. 5 (full lines).

The actuation means of the second hydraulic cylinder 74, again, is of the type well known in the art and available on the market by a great number of different manufacturers of hydraulic elements. Therefore, it need not be described in greater detail. The available tilt of the support beams 69, 70 from a horizontal plane is approximately 20°. Fixedly but selectively adjustably secured to the support beams 69, 70 near the pivots 76, 77 is an inner lifting pad 78 to which is fixedly secured an oblique rugged shield 79.

Near the opposite end of the support beams 69, 70 is adjustably secured an outer lifting pad 80. The outer lifting pad 80 is generally parallel with the pad 78 and is provided, like the lifting pad 78, with a drive-on ramp 81 at each end of the respective lifting pad 78, 80. The pad 80 is basically of a flat box-shaped structure, including, in each face and near the upper surface of the pad 80 a longitudinal slot which is only slightly greater in cross-sectional area than the cross-section of the drive-on ramp 81. The drive-on ramp 81 can assume two positions, a fully extended position as shown at front end of pad 80 in FIG. 1 and a retracted position shown at the front of pad 78 of the same figure. Reference may also be had to FIG. 6. Disposed interiorly of the outer lifting pad 80 and near its front wall and of the rear wall 83 thereof are guide ledges 84, each of a hook-shaped configuration and sloping downwardly and inwards. When the ramp 82 is pushed inside the box of the pad 80, (right-hand side of FIG. 6) the guides 84 maintain the ramp 81 in a position wherein the respective ramp 81 slopes from its slot or passage through the end wall of the pad 80, downwardly and inwardly of the pad 80. The short, upright section 84*a* of the hook-shaped configuration of the guides 84 limits inwards movement of the ramp 81 such that its outer or front edge is generally flush with the slot in the end of the respective pad 78 or 80. A notch is provided in the pad 80 or 78 near the end thereof so that the operator may reach in and grasp the ramp to pull it out (the notch not shown in the drawings). The opposite end of each of the ramps 81 can be provided with suitable retaining means such as a pin 85 or the like extending beyond the ends of the slot in the end wall of the respective pad 80 or 78, to prevent complete withdrawal of the ramp from the respective pad.

The inwardly facing surfaces of the support beams 69, 70 are each provided with a longitudinal row of locking protrusions 86 adapted to engage locking mechanism shown in greater detail in FIG. 6 and 7.

It will be observed that a U-shaped handle 87 protrudes forwardly (as viewed in FIG. 1) from a transverse slot 88 in the pad 80. Two upright mounting plates 89 are fixedly secured to the pad 80 by welding, and extend along the slot 88, at an inward spacing from the respective row of the locking protrusions 86. Pivot pins 90 secure the respective arms of the handle 87 to the plates 89. The pivot securement by the pins 90 is intermediate between free end of the respective arm and the transverse grasp section disposed exteriorly of the slot 88. At the free ends of the arms of the handle is fixedly secured a transverse rod 91 whose ends are so shaped and dimensioned that when the grasp section is down, the ends of the rod 91 are each disposed between a pair of adjacent protrusions 86 thus preventing displacement of the pad 80 along the beams 69, 70, while the lifting of the grasp section results in a tilt about the axis of pins 90, whereby the transverse rod 91 is displaced downwards of FIG. 6 or 7, out of engagement with the protrusions 86 to allow the sliding of the pad 80 along the beams 69, 70. The forward or grasp end of the handle 87 is weighted such that it is normally urged downwards, to maintain the transverse rod 91 in engagement with the protrusions 86, the arrangement being such that the rod 91 cannot assume a position above the protrusions 86 as viewed in FIG. 6 due to suitable stop means (not shown), for instance suitably shaped recesses in the plates 89, limiting the upwards movement of the rod 91.

Turning now to FIGS. 8 and 9, the side member 14 and the spacer 15 are secured to each other by an upwardly turned flange 95 provided with an upright slot 96 receiving a bolt 97. The head 98 of the bolt is disposed exteriorly of the flange 95 and of the side member 14 which is of a box-shaped structure and houses the mechanism of the ground wheel 22. Inside the side member 14, the stem of the bolt 97 pivotally supports a sleeve 99 fixedly secured to one end of a swing arm 100 comprised of two side pieces as best shown in FIG. 9. The free end of the swing arm supports the ground wheel. On downward swing of the arm 100, the wheel 22 protrudes out of the side member 14 through a cutout 101 in the bottom wall thereof. A leaf spring 102 is disposed between the arms of the swing arm 100. One end of the spring 102 is hooked to a transverse strut 103 at 104. The spring extends under the sleeve 99 and rests with its other end against the bottom wall of the box-shaped side member 14, at 105. The spring 102 is so arranged and disposed that when there is no load on the hoist, the wheel 22 protrudes downwardly to facilitate the handling. Once there is load on the hoist, the wheel is forced against the action of the spring 102 into the side member.

Those skilled in the art will readily appreciate modifications of the preferred embodiment described above, departing from the preferred embodiment shown, but still falling within the scope of the present invention as recited in the accompanying claims.

The embodiments of the invention in which an exclusive property or privilege is claimed are defined as follows.

1. A vehicle hoist of the type including (a) a base disposed normally horizontally on the ground and having a first end portion and a second end portion;

(b) a column fixedly secured to the base and extending upwards therefrom at an inclination such that a bottom end of the column is secured to said base at a point relatively close to but spaced from said first end portion and a top end of said column is generally vertically above said first end portion;

(c) carriage means including a carriage disposed in said column for movement therein in the direction from one of said ends of the column to the other;

(d) first hydraulic power means operatively associated with said carriage means for selectively moving same along the column on actuation of manual control means;

(e) vehicle support means secured to said carriage and protruding from same in a direction away from that face of said column which is turned away from said first end portion;

(f) mechanical lock means normally biased such as to prevent the movement of said carriage means in the direction from the top end to the bottom end of the column;

(g) manual lock release means independent of and distinct from said manual control means for actuating said lock means against its bias, the manual lock release means being of the type requiring a continuous manual force to maintain the lock means in released state; whereby an operator must use his both hands to initiate the descent of said carriage means and must maintain manual force on said lock release means throughout the descending of the carriage means;

(h) said lock release means being disposed at that face of said column which is turned away from the vehicle support means;

(i) said column being a structure of channel-shaped cross-sectional configuration comprising a generally solid bottom wall provided with a plurality of transverse locking protrusions, a pair of side walls extending along each side of the bottom wall, each side wall having a longitudinally inwardly turned flange forming guide means for said carriage, for guiding said carriage along the bottom walls;

(j) said carriage being provided with two transverse locking rods, one near an upper end of the carriage, the other near a lower end of the carriage, each locking rod being provided with spring means engaging a central portion of the respective rod and urging the respective locking rod into engagement with said locking protrusion such that said carriage is mechanically supported by said locking protrusions at two discrete locations near the upper end of the carriage and at two further discrete locations near the lower end thereof;

(k) said locking protrusions being disposed adjacent each other such that they form a wavy contour in cross-section, each protrusion including a locking surface generally perpendicular to the bottom wall and having a free end portion remote from said bottom wall and merging with a wedging surface extending from the free end portion downwards and then merging with the bottom wall immediately above the locking surface of the adjacent protrusion therebelow, whereby the movement of the carriage means upwards results in automatic release of the locking bar means in a ratchet-like fashion; and (l) lock release bar extending along said bottom wall generally centrally thereof, said lock release bar being of a generally uniform, rectangular cross-section throughout its length and being so disposed that in an inoperative position one longer side of the rectangle generally coincides with said bottom wall while the opposite longer side of the rectangle is closely spaced from said locking rods when the latter are engaged with the respective locking surface, said lock release bar being pivotable about a longitudinal axis and being provided with a handle for manually pivoting the release bar from the inoperative position to an operative position wherein one corner at said opposite longer side engages both said locking rods and forces them out of engagement with the respective locking protrusions.

2. A vehicle hoist as claimed in claim 1, wherein the angle of displacement of said lock release bar from the inoperative position to the operative position is less than 90°, whereby the lock release bar is urged at all operative positions thereof by the locking rods back towards its inoperative position to thus force the operator to hold said handle at all times during the lowering of the carriage.

3. A hoist as claimed in claim 1, wherein the lock release bar is fixedly secured to a handle bar protruding through a passage in said bottom wall at approximately mid-height thereof, whereby a manual pressure must be exerted on the handle bar to release the locking bars from engagement with the locking protrusions.

* * * * *